US006488840B1

(12) United States Patent
Greaney et al.

(10) Patent No.: US 6,488,840 B1
(45) Date of Patent: Dec. 3, 2002

(54) MERCAPTAN REMOVAL FROM PETROLEUM STREAMS (LAW950)

(75) Inventors: Mark Alan Greaney, Upper Black Eddy, PA (US); Michael Charles Kerby, Baton Rouge, LA (US); Roby Bearden, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/551,010

(22) Filed: Apr. 18, 2000

(51) Int. Cl.[7] ..... C10G 27/00; C10G 27/04; C10G 27/06

(52) U.S. Cl. ..... 208/189; 208/203; 208/204; 208/226; 208/237; 208/238; 208/240

(58) Field of Search ..... 208/189, 203, 208/204, 226, 237, 238, 240

(56) References Cited

U.S. PATENT DOCUMENTS

| | | | | | |
|---|---|---|---|---|---|
| 1,796,621 | A | | 3/1931 | Ramage | 208/232 |
| 1,968,842 | A | | 8/1934 | Malisoff | 196/24 |
| 1,973,499 | A | | 9/1934 | Morrell | 196/24 |
| 2,059,075 | A | | 10/1936 | Yabroff et al. | 196/32 |
| 2,152,166 | A | | 3/1939 | Yabroff | 196/32 |
| 2,152,720 | A | | 4/1939 | Yabroff | 196/32 |
| 2,152,721 | A | | 4/1939 | Yabroff | 196/32 |
| 2,152,723 | A | | 4/1939 | Yabroff | 196/32 |
| 2,160,632 | A | | 5/1939 | Yabroff et al. | 196/32 |
| 2,168,078 | A | | 8/1939 | Yabroff | 196/32 |
| 2,183,801 | A | | 12/1939 | Yabroff | 196/32 |
| 2,186,398 | A | | 1/1940 | Yabroff | 196/32 |
| 2,212,105 | A | | 8/1940 | Yabroff | 196/32 |
| 2,212,106 | A | | 8/1940 | Yabroff | 196/32 |
| 2,212,107 | A | | 8/1940 | Yabroff | 196/32 |
| 2,297,866 | A | | 10/1942 | Benedict | 196/32 |
| 2,309,651 | A | | 2/1943 | McCullough et al. | 196/32 |
| 2,425,777 | A | | 8/1947 | Adams et al. | 196/30 |
| 2,437,348 | A | | 3/1948 | Brown et al. | 196/32 |
| 2,570,277 | A | | 10/1951 | Ricards, Jr. et al. | 196/32 |
| 2,593,851 | A | | 4/1952 | Cool et al. | 196/32 |
| 2,608,519 | A | | 8/1952 | Deters et al. | 196/24 |
| 2,634,230 | A | | 4/1953 | Arnold et al. | 196/24 |
| 2,776,929 | A | | 1/1957 | Vanderbilt | 196/32 |
| 2,792,332 | A | | 5/1957 | Hutchings | 196/14.17 |
| 4,124,493 | A | | 11/1978 | Frame | 208/206 |
| 4,156,641 | A | | 5/1979 | Frame | 208/207 |
| 4,206,079 | A | | 6/1980 | Frame | 252/428 |
| 4,290,913 | A | | 9/1981 | Frame | 252/428 |
| 4,298,463 | A | * | 11/1981 | Frame | 208/189 |
| 4,337,147 | A | | 6/1982 | Frame | 208/206 |
| 4,626,341 | A | | 12/1986 | Verachtert | 208/235 |
| 4,705,620 | A | * | 11/1987 | Bricker et al. | 208/206 |
| 4,753,722 | A | | 6/1988 | Le et al. | 208/207 |
| 4,824,818 | A | | 4/1989 | Bricker et al. | 502/163 |
| 4,897,180 | A | * | 1/1990 | Bricker et al. | 208/189 |
| 4,908,122 | A | * | 3/1990 | Frame et al. | 208/207 |
| 4,913,802 | A | * | 4/1990 | Bricker et al. | 208/207 |
| 4,923,596 | A | * | 5/1990 | Bricker et al. | 208/207 |
| 5,167,797 | A | | 12/1992 | Ou | 208/236 |
| 5,273,646 | A | | 12/1993 | Frame et al. | 208/189 |
| 5,290,427 | A | | 3/1994 | Fletcher et al. | 208/89 |
| 5,582,714 | A | | 12/1996 | Forte | 208/237 |
| 5,840,177 | A | | 11/1998 | Weers et al. | 208/208 R |
| 5,985,136 | A | | 11/1999 | Brignac et al. | 208/216 R |
| 6,013,175 | A | | 1/2000 | Weers et al. | 208/208 R |
| 6,013,598 | A | | 1/2000 | Lapinski et al. | 502/305 |
| 6,174,431 | B1 | * | 1/2001 | Williams et al. | 208/183 |
| 6,179,999 | B1 | * | 1/2001 | Sherman et al. | 208/183 |
| 6,238,551 | B1 | * | 5/2001 | Sherman et al. | 208/181 |
| 6,372,122 | B1 | * | 4/2002 | Gorman | 208/181 |
| 6,398,948 | B1 | * | 6/2002 | Sherman et al. | 208/183 |

OTHER PUBLICATIONS

Satchell, Donald P., Jr.; "Effect of Olefins on Hydrodesulfurization of a Cracked Naphtha Reformer Feed", Michigan State University, East Lansing, Michigan, 1969.

Holbrook, D. L., UOP, Des Plaines, Illinois; "UOP Merox Process", Chapter 11.30 (Handbook of Petroleum Refining Processes, Robert A. Meyers, Editor in Chief, Second Edition); published by McGraw–Hill. No date.

California Oil World, Petroleum Publishers, Inc., C. Monroe, President and Editor; Second Issue, Apr., 1944, vol. 37, No. 8, Whole No. 1655, p. 1, Apr. 27, 1944.

Moriarty, F. C., Universal Oil World Products Co., Chicago; "Unisol Treatment Effects Large Savings for Big West Oil Company"; California Oil World, Petroleum Publishers, Inc., Second Issue, Apr., 1944, pp. 19–20.

Border, L. E., Shell Oil Co., Inc., Wood River, Illinois; "Solutizer—A New Principle Applied to Gasoline Sweetening", Chemical & Metallurgical Engineering, Nov. 1940, pp. 776–778.

Moriarty, F. C., Universal Oil Products Co., Chicago; "Effective Method for Reducing Mercaptans Cuts Refining Costs"; Petroleum World, pp. 53–55. No date.

Yabroff, D. L. and White, E. R., Shell Development Company, Emeryville,California; "Action of Solutizers in Mercaptan Extraction"; Industrial and Engineering Chemistry, Jul. 1940, pp. 950–953.

Band, C. H, and Cluer, A.; "Application of the Unisol Process in Great Britain"; Petroleum, Sep., 1958, pp. 305–308.

Lyles, H. R., Cities Service Refining Corporation, Lake Charles, Louisiana; "New Unisol Stripper Improves Operations", Petroleum Refiner, Mar., 1955, pp. 207–209.

Mason, C. F., Bent, R. D, and McCullough, J. H., The Atlantic Refining Co, Philadelphia, PA.; "Naphtha Treating 'Pays Its Way"; Division of Refining, vol. 22[III], 1941, pp. 45–51.

(List continued on next page.)

*Primary Examiner*—Nadine G. Norton
(74) *Attorney, Agent, or Firm*—Estelle C. Bakun; Gerard J. Hughes

(57) ABSTRACT

This invention relates to reducing the amount of thiols (mercaptans) in petroleum streams, specifically, mercaptans above the five carbon molecular weight range.

17 Claims, 2 Drawing Sheets

OTHER PUBLICATIONS

Moriarty, F. C.; "Unisol Process for Treating Gasoline" (Mercaptans Removed by Extraction with Concentrated Solution of Caustic Soda Containing Methanol; The Petroleum Engineer, Apr. 1944, pp 150–152.

Bent, R. D. and McCullough J. H.; "Unisol Process"; The Oil and Gas Journal, Sep. 9, 1948, pp. 95, 97, 100, 103.

Mason, C. F., Bent, McCullough, Atlantic Refining Co., Philadelphia, PA.; "Naphtha Treating Pays Its Way", The Oil and Gas Journal, Nov. 6, 1941, pp. 114, 116, 119.

O'Donnell, John P.; "Tannin Solutizer Process Practically Automatic; Saves 6.5 Cents Per Barrel", The Oil and Gas Journal, Engineering and Operating Section, Jul. 1, 1944, pp. 45–47.

Border, L. E., Shell Oil Co., Inc.; "Shell Operating First Solutizer Treating Plant at Wood River", The Oil and Gas Journal, Engineering and Operating Sections; Nov. 7, 1940, pp. 55–56.

Lowry Jr., C. D. and Moriarty, F. C.; "Unisol Process Improves Octane Number and TEL Susceptibility"; The Oil and gas Journal, Nov. 3, 1945, pp. 105, 107, 109.

Field, H. W., Atlantic Refining Co., Philadelphia, PA.; "Caustic–Methanol Mercaptan Extraction Process Used"; The Oil and Gas Journal, Sep. 25, 1941, pp. 40–41.

* cited by examiner

MERCAPTAN REMOVAL FROM PETROLEUM STREAMS (LAW950)

FIELD OF THE INVENTION

This invention relates to the removal of thiols (mercaptans) from petroleum streams. Specifically, mercaptans of the five-carbon molecular weight range and above can be removed from petroleum streams. Removal of light thiols (less than $C_5$ molecular weight), an enhancement to base assisted extractive processes such as extractive Merox®, may also be improved.

BACKGROUND OF THE INVENTION

To prepare fuels, which satisfy regulatory sulfur limits, it is necessary to process the fuels to remove various sulfur species. For example, long chain mercaptans are not native to crude, but are produced during the hydrotreatment of olefin-containing petroleum streams to remove sulfur species such as thiophenes. The byproduct, hydrogen sulfide, from the hydrodesulfurization process reacts with olefins present in the feeds to produce longer chain, higher molecular weight mercaptans. Normally, short chain (less than $C_5$) mercaptans are easily and cheaply removed from such streams by base assisted extractive processes such as extractive Merox®. However, due to the insolubility of the longer chain mercaptans in caustic, the normal extractive process is less effective. In the extractive process, the thiols are extracted from the petroleum stream into an aqueous caustic solution in the absence of air. The aqueous and petroleum streams are then separated. Once isolated from the petroleum stream, the extracted mercaptans in the aqueous stream are then catalytically oxidized with air and converted to disulfides. These disulfides are separated from the aqueous stream and disposed of into a waste stream. The limitation to this process is the solubility of the thiol in aqueous caustic. Thiols with chain lengths beyond five carbons are too oleophilic to be extracted into the aqueous phase and therefore cannot be fully removed by this process.

A large body of art exists in the patent literature describing additives used in conjunction with aqueous base to overcome the limitation due to the insolubility of long-chain mercaptans. All of these additives are added in substantial quantities (>10 wt % of aqueous phase) in order to modify the "solvent power" of the caustic solution. In more modem terminology, these additives alter the solvent parameters of the aqueous caustic. The additive's impact on solvent properties are proportional to the quantity added and therefore substantial quantities of additive are required to produce the substantive change required. In the literature these are commonly referred to as "solubilizing agents" or "solutizers." For example U.S. Pat. No. 2,059,075 describes the addition of "substantial" amount of quaternary ammonium hydroxide to aqueous caustic to enhance mercaptan extraction. Other agents such as propyleneglycol (U.S. Pat. No. 2,183,801), butyleneglycols (U.S. Pat. No. 2,152,166), triethyleneglycol (U.S. Pat. No. 2,212,105) have been cited. In the ethyleneglycol family of additives, species containing greater than six carbons were noted as being "unsuitable". Typically the preferred range of use for these solubilizers is from 25–75 wt % relative to the aqueous caustic. The use of such large quantities of expensive reagents and attendant problems of separation from extracted petroleum, undesirable decomposition and byproducts at operating conditions, etc, in using such large quantities, have precluded their widespread use in commercial practice.

One of these classes of additives, quaternary ammonium halides, has been found to be effective in low concentration for a sweetening process when used in conjunction with oxygen, oxidation catalyst and alkali metal hydroxide (U.S. Pat. No. 4,124,493). Subsequent patents (U.S. Pat. Nos. 4,156,641 4,206,079, 4,290,913 and 4,337,147) disclose the use of quaternary ammonium hydroxides in conjunction with a mercaptan oxidizing catalyst as components of solid oxidation catalyst composites to be used in the presence of oxygen for sweetening applications.

Another approach to reducing the sulfur content of petroleum streams has been to conduct bulk solvent extraction on the stream, such as is described in U.S. Pat. No. 2,792,332. This approach leads to losses of 20% of the original feed volume, which is unacceptable in many cases.

Other mercaptan removal or destruction processes are available, however, they remove sulfurs at the cost of saturating olefins, thereby decreasing the octane of the fuel being produced. For example, non-selective high-pressure catalytic hydrodesulfurization can be used to hydrogenate all olefins and ultimately reduce mercaptans but at a very high-octane loss.

Thus, what is needed in the art is a process for removing mercaptans, especially $\geqq C_5$+ mercaptans, while maintaining octane.

SUMMARY OF THE INVENTION

The instant process describes a method for removal of mercaptans from petroleum streams comprising the steps of:

(a) extracting said petroleum stream, in the substantial absence of oxygen, with an aqueous medium comprising an aqueous base and a catalytically effective amount of a phase transfer catalyst or an aqueous solution of a catalytically effective amount of a basic phase transfer catalyst to remove said mercaptans from said petroleum stream;

(b) Separating and recovering an aqueous stream containing mercaptide anions and a petroleum stream having a reduced amount of mercaptans, and wherein when said phase transfer catalyst is a quaternary ammonium hydroxide, said quaternary ammonium cation has the formula:

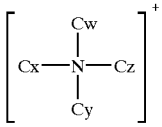

where q=1/w+1/x+1/y+1/z and wherein q≧1.0 and wherein, Cw, Cx, Cy, and Cz represent alkyl radicals with carbon chain lengths of w, x, y and z carbon atoms respectively.

The process may also comprise steps of:

(c) subjecting said aqueous stream to oxidation to convert mercaptide anions contained therein to disulfides;

(d) separating said disulfides and recovering an aqueous stream having disulfides removed therefrom;

(e) recycling said aqueous stream to said step (a) wherein said aqueous stream contains said base and said phase transfer catalyst or said basic phase transfer catalyst of said step (a).

DETAILED DESCRIPTION OF THE INVENTION

Figure 1:
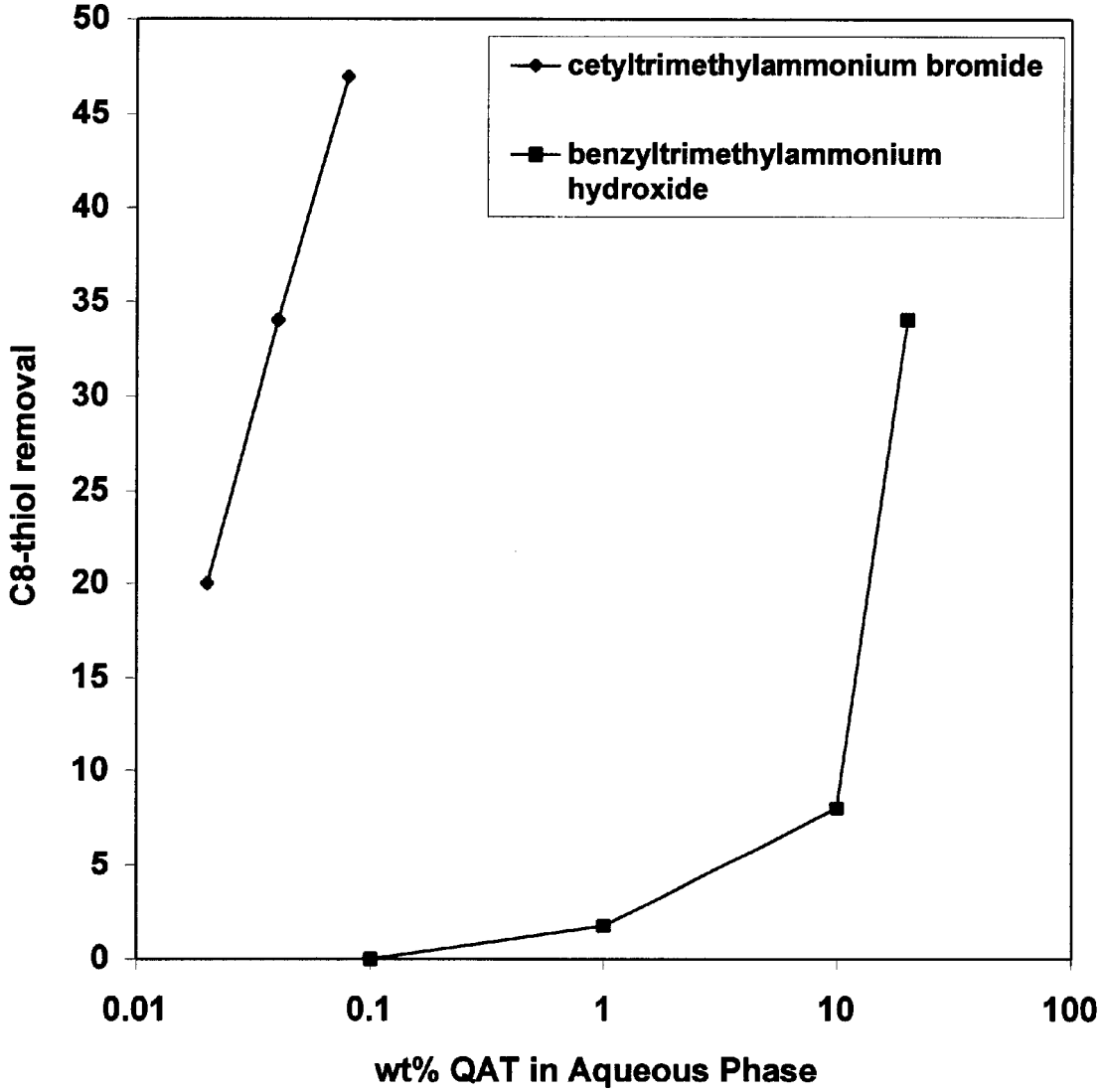
FIG. 1 is a plot of n-octylthiol (C8-thiol) removal as a function of the amount of quaternary ammonium salt added to 10 wt % sodium hydroxide solutions for two different quaternary ammonium salts in the absence of air.

As used herein, substantial absence of oxygen means no more than that amount of oxygen which will be present in a refinery process despite precautions to exclude the presence of oxygen. Typically, 10 ppm or less, preferably 2ppm or less oxygen will be the maximum amount present. Preferably, the process will be run in the absence of oxygen.

This invention includes the removal of thiols (mercaptans) from petroleum streams, specifically, mercaptans comprising mercaptans of five carbon molecular weight and above. Lower molecular weight mercaptans and mercaptans which contain non-linear alkyl chains may also be removed during the process.

The invention includes the use of a basic phase transfer catalyst (PTC) in water or a combination of phase transfer catalyst and aqueous base to remove mercaptans from petroleum streams. The streams may have previously undergone other forms of sulfur removal for non-mercaptan type species such as thiophenes and aliphatic sulfides. Such processes include, processes known in the art such as, for example, SCANfining as taught by U.S. Pat. No. patent 5,985,136, herein incorporated by reference, hydrodesulfurization, etc. The streams may also have previously undergone caustic extraction to reduce the short-chain thiol concentration prior to the instant treatment such as extractive Merox®.

In conducting the instant process, the extracting medium may consist essentially of or consist of aqueous base and phase transfer catalyst. However, if the phase transfer catalyst is sufficiently basic (capable of deprotonating a mercaptan with a pKa of <16) in water, it may be used alone to accomplish the extraction. Quaternary ammonium hydroxide salts, such as tetrabutylammonium hydroxide, are examples of the latter.

The use of suitable basic phase transfer catalyst or PTC in combination with aqueous base may dramatically reduce the presence of C5+ thiols (at least about 70, preferably, at least about 75% removal).

The addition of a phase-transfer catalyst allows for the extraction of these higher molecular weight mercaptans (≧C5+) into the aqueous caustic at a rapid rate. The aqueous phase can then be separated from the feedstream by known techniques. Likewise, lower molecular weight mercaptans, if present, are also removed during the process.

The phase transfer catalysts which can be utilized in the instant invention can be supported or unsupported. The attachment of the PTC to a solid substrate facilitates its separation and recovery and reduces the likelihood of contamination of the product petroleum stream with PTC. Typical materials used to support PTC are polymers, silicas, aluminas and carbonaceous supports.

In one embodiment of this invention, the PTC and aqueous base will be supported on or contained within the pores of a solid state material to accomplish the mercaptan extraction. After saturation of the supported PTC bed with mercaptide in the substantial absence of oxygen, the bed can be regenerated by flushing with air and a stripper solvent to wash away the disulfide which would be generated. If necessary, the bed could be re-activated with fresh base/PTC before being brought back on stream. This swing bed type of operation may be advantageous relative to liquid-liquid extractions in that the liquid-liquid separation steps would be replaced with solid-liquid separations typical of solid adsorbent bed technologies.

Embodiments of the invention include liquid-liquid extraction where aqueous base and water soluble PTC are utilized to accomplish the extraction, or basic aqueous PTC is utilized. A liquid-liquid extraction with aqueous base and supported PTC where the PTC is present on the surface or within the pores of the support, for example a polymeric support; and liquid-solid extraction where both the basic aqueous PTC or aqueous base and PTC are held within the pores of the support.

Thus an "extractive" process whereby the thiols are first extracted from the petroleum feedstream in the substantial absence of air into an aqueous phase and the mercaptan-free petroleum feedstream is then separated from the aqueous phase and passed along for further refinery processing can be conducted. The aqueous phase may then subjected to aerial oxidation to form disulfides from the extracted mercaptans. Separation and disposal of the disulfide would allow for recycle of the aqueous phase. The disulfide is readily separated by extraction with an organic extractant in which the disulfides are soluble. Such extractants are easily selected by the skilled artisan and can include for example a reformate stream.

If it is desired to conduct a sweetening process, the extraction step can be conducted in air, the loss of thiol is concurrent with generation of disulfide. This indicates a "sweetening process", in that the total sulfur remains essentially constant in the feedstream, but the mercaptan sulfur is converted to disulfide. Furthermore, the thiol is transported from the organic phase into the aqueous phase, prior to conversion to disulfide then back into the petroleum phase. We have found this oxidation of mercaptide to disulfide to occur readily at room temperature without the addition of any other oxidation catalyst. When conducting a sweetening process, the extracting medium will consist essentially of aqueous base and PTC or aqueous basic PTC. In a sweetening process, no catalysts other than the PTC(s) will be present.

When utilizing a supported PTC, the porous supports may be selected from, molecular sieves, polymeric beads, carbonaceous solids and inorganic oxides for example.

It is believed that, higher molecular weight mercaptans are extracted from the petroleum feedstream into the basic solution which is contained within the pores of an appropriate solid support such as a "molecular sieve". This is achieved by bringing into contact the solid-supported aqueous basic solution with the petroleum stream by conventional methods such as are used in solid adsorbent technologies well known in the art. Upon contact, the mercaptide anion should be generated and transported into the aqueous phase within the pores of the molecular sieves. The mercaptan-free petroleum effluent stream is now ready for normal processing. With time, the capacity of the bed will be exceeded and the thiol content of the effluent will rise. At this point the bed will need to be regenerated. A second adsorbent bed will be swung into operation. Regeneration of the first bed will be accomplished by introduction of oxygen (air) into the bed along with an organic phase which will provide a suitable extractant stream for the disulfide which should form upon oxidation of the mercaptide anions. Such extractants are easily chosen by the skilled artisan. Pressure and heat could be used to stimulate the oxidative process. If necessary, the stripped bed could be regenerated by re-saturation with fresh base/PTC solution before being swung back into operation. Neither the base nor the PTC are consumed in this process, other than by losses due to contaminants. The advantage of using a supported PTC is that the mercaptans are trapped within the pores of the support facilitating separation.

Bases preferred are strong bases, e.g., sodium, potassium and ammonium hydroxide, and sodium and potassium carbonate, and mixtures thereof. These may be used as an aqueous solution of sufficient strength, typically base will be up to or equal to 50 wt % of the aqueous medium, preferably about 15% to about 25 wt % when used in conjunction with onium salt PTCs and 30–50 wt % when used in conjunction with polyethyleneglycol type PTCs.

The phase transfer catalyst is present in a sufficient concentration to result in a treated feed having a decreased mercaptan content. Thus, a catalytically effective amount of the phase transfer catalyst will be utilized. The phase transfer catalyst may be miscible or immiscible with the petroleum stream to be treated. Typically, this is influenced by the length of the hydrocarbyl chains in the molecule; and these may be selected by one skilled in the art. While this may vary with the catalyst selected, typically concentrations of about 0.01 to about 10 wt. %, preferably about 0.05 to about 1 wt % based on the amount of aqueous solution will be used.

Phase transfer catalysts (PTCs) suitable for use in this process include the types of PTCs described in standard references on PTC, such *as Phase Transfer Catalysis: Fundamentals Applications and Industrial Perspectives* by Charles M. Starks, Charles L. Liotta and Marc Halpern (ISBN 0-412-04071-9 Chapman and Hall, 1994). These reagents are typically used to transport a reactive anion from an aqueous phase into an organic phase in which it would otherwise be insoluble. This "phase-transferred" anion then undergoes reaction in the organic phase and the phase transfer catalyst then returns to the aqueous phase to repeat the cycle, and hence is a "catalytic" agent. In the invention, it is believed that, the PTC transports the hydroxide anion, $^{-}OH$, into the petroleum stream, where it reacts with the thiols in a simple acid base reaction, producing the deprotonated thiol or thiolate anion. This charged species is much more soluble in the aqueous phase and hence the concentration of thiol in the petroleum stream is reduced by this chemistry.

A wide variety of PTC would be suitable for this application. These include onium salts such as quaternary ammonium and quaternary phosphonium halides, hydroxides and hydrogen sulfates for example. When the phase transfer catalyst is a quaternary ammonium hydroxide, the quaternary ammonium cation will have the formula:

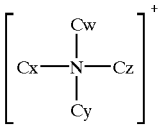

where $q=1/w+1/x+1/y+1/z$ and wherein $q \geqq 1.0$. Preferably, $q \geqq 3$. In this formula, Cw, Cx, Cy, and Cz represent alkyl radicals with carbon chain lengths of w, x, y and z carbon atoms respectively. The preferred quaternary ammonium salts are the quaternary ammonium halides. The four alkyl groups on the quaternary cation are typically alkyl groups with total carbons ranging from four to forty, but may also include cycloalkyl, aryl, and arylalkyl groups. Some examples of useable onium cations are tetrabutyl ammonium, tetrabutylphosphonium, tributylmethyl ammonium, cetyltrimethyl ammonium, methyltrioctyl ammonium, and methyltricapryl ammonium. In addition to onium salts, other PTC have been found effective for hydroxide transfer. These include crown ethers such as 18-crown-6 and dicyclohexano- 18-crown-6 and open chain polyethers such as polyethyleneglycol 400. Partially-capped and fully-capped polyethyleneglycols are also suitable. This list is not meant to be exhaustive but is presented for illustrative purposes. Supported or unsupported PTC and mixtures thereof are utilizable herein.

The amount of aqueous medium to be added to said petroleum stream being treated will range from about 5% to about 200% by volume relative to petroleum feed.

While process temperatures of from 25° C. to 180° C. are suitable, lower temperatures of less than 25° C. can be used depending on the nature of the feed and phase transfer catalyst used. The pressure should be sufficient pressure to maintain the petroleum stream in the liquid state. Oxygen must be excluded, or be substantially absent, during the extraction and phase separation steps to avoid the premature formation of disulfides, which would then redissolve in the feed. Oxygen is necessary for a sweetening process.

Following the extraction of the mercaptans, and separation of the mercaptan free petroleum stream, the stream is then passed through the remaining refinery processes, if any. The base and PTC or basic PTC may then be recycled for extracting additional mercaptans from a fresh petroleum stream.

The mixture of PTC and base may consist essentially of or consist of PTC and base. When using basic PTCs, they may consist essentially of or consist of basic PTC's. Preferably, the invention will be practiced in the absence of any catalyst other than the phase transfer catalyst such as those used to oxidize mercaptans, e.g. metal chelates as described in U.S. Pat. No. 4,124,493; 4,156,641; 4,206,079; 4,290,913; and 4,337,147. Hence in such cases the PTC will be the only catalyst present.

The following examples are illustrative and are not meant to be limiting in any way.

EXAMPLES

Example 1

Fifty milliliters of a model petroleum stream consisting of 200 wppm of n-octylthiol in hexane was deaerated by twenty cycles of evacuation and argon refilling. This was then mixed with a similarly deaerated fifty milliliters of an aqueous solution containing 20 wt % sodium hydroxide. After 15 minutes of mixing under argon, the mixer was stopped and the phases were allowed to separate. A sample of the organic phase was analyzed by gas chromatography and showed a loss of 2% of the original n-octylthiol and no formation of disulfide. The estimated error for these measurements is +/−5%. This experiment demonstrates essentially no extraction of thiol from the organic phase by sodium hydroxide alone. For comparison, the experiment was repeated exactly, except that 800 wppm (relative to the aqueous phase weight) of cetyltrimethylammonium bromide (CTAB) was added to the aqueous phase. This time, the product organic phase showed 81% thiol extraction with no disulfide formation. The phase transfer agent, CTAB, is required to achieve significant long-chain thiol extraction.

Example 2

The same procedure as that described in Example 1 was performed, except that the concentration of sodium hydroxide was reduced to 10 wt % and a series of different CTAB concentrations was added to ascertain the impact of CTAB concentration on thiol removal. The CTAB concentration added in three separate experiments was 200, 400 and 800 wppm relative to the weight of the aqueous phase. The amount of n-octylthiol removed was 20%, 34% and 47% respectively. An extraction with 10 wt % sodium hydroxide with no added CTAB produced a 2% thiol removal.

Comparative Example

Extractions of n-octylthiol in hexane were conducted in the absence of air by mixing together equal volumes of an aqueous phase and a thiol/hexane phase as described in Example 1. The aqueous phase consisted of 2.5 N sodium hydroxide (about 10 wt %) in water with a variable concentration of benzyltrimethylammonium hydroxide (BZTMOH). Four separate experiments at the following concentrations of BZTMOH were conducted: 20 wt %, 10 wt %, 1 wt % and 1000 wppm relative to the total aqueous phase weight. This basic quatemaryammonium hydroxide and experimental conditions were those reported in U.S. Pat. No. 2,059,075. The following percentages of n-octylthiol removal were determined by gas chromatographic analysis: 34%, 8%, 2% and 0% respectively. The results of these extractions and those from Example 2 are plotted together in FIG. 1. Clearly, the quat salt cited in this patent is not effective as a phase transfer catalyst, but rather is acting as a solutizer and is only effective in high concentrations.

The results are shown in FIG. 1.

Example 3

The same procedure as in Example 1 was followed except for the substitution of a highly branched mercaptan, 2-Methyl-2-propanethiol (tert-butyl mercaptan), for the n-octylthiol. Sixty-four percent thiol removal was achieved.

Example 4

The requirement for air to form disulfide was demonstrated as follows. A model feed containing 1000 ppm octanethiol in pentane was deaerated on a Schlenck line under an argon atmosphere by three freeze-pump-thaw cycles. This should reduce the oxygen content to less than 10 ppm. An aqueous solution containing 10 wt % tetrabutylammonium hydroxide and 10 wt % sodium hydroxide was degassed by purging with nitrogen for one hour. Equal volumes of the two phases were combined under strictly airless conditions, mixed vigorously for one minute and then allowed to separate for five minutes. A sample was then removed by syringe for gc analysis. The thiol concentration dropped from 1000 ppm to 242 ppm with only a very slight increase in disulfide concentration (from 6 to 8 ppm). The flask containing the two phases was then bubbled briefly with air (15 sec), restoppered, stirred for one minute and allowed to separate for five minutes. Gas chromatographic analysis of the organic phase now shows further extraction of thiol (242 ppm to 132 ppm) but most significantly, a sharp increase in disulfide content (8 ppm to 144 ppm). Further stirring of the solution under air overnight resulted in nearly complete thiol removal (7 ppm) and conversion to disulfide (477 ppm). This result clearly demonstrates the ability to extract $C5^+$ mercaptans from a petroleum feedstream in the absence of air and the necessity of air for the conversion of thiol to disulfide.

Example 5

The procedure of Example 4 was repeated, except that after mixing the two deaerated solutions for four minutes and allowing them to phase separate, three quarters of the aqueous phase was removed from the flask by syringe, leaving behind all of the original "feedstream" and one quarter of the aqueous extractant phase. All of the aqueous phase was not removed so as to avoid any possibility of removing any of the original organic phase. The octane thiol had been nearly quantitatively extracted from the pentane phase (1000 ppm to 20 ppm). The portion of the aqueous phase which had been removed was then combined with fresh pentane of equal volume to the original feedstream and mixed in air overnight. GC analysis of the pentane solution showed a 282 ppm disulfide concentration. This experiment demonstrates that the thiol removed from the feedstream is extracted quantitatively into the aqueous phase. Exposure of this aqueous phase (which now contains mercaptides) to air converts these mercaptides to disulfides, which are then readily extracted out of the aqueous phase into a suitable organic solvent (pentane in this example) for disposal.

Example 6 & 7

Two airless (oxygenless) extractions of a real feed containing 73% mercaptan sulfur and 27% non-mercaptan sulfur were conducted. The feed chosen was a hydrotreated intermediate catalytic cracked naphtha (ICN). Two different phase transfer agents were employed separately. One was 40 wt % tetrabutylammonium hydroxide in water and the second was 1000 wppm of cetyltrimethylammonium bromide in a 10 wt % sodium hydroxide in water solution. Extraction under argon at room temperature with a 1:1 volume ratio by mixing vigorously for five minutes reduced the total sulfur content by 72 and 77% respectively as determined by X-ray fluorescence spectroscopy (XRF). Hence 100±5% mercaptan sulfur was removed.

Examples 8, 9, and 10 were conducted in the presence of air.

Example 9

A series of room temperature extractions of a model petroleum stream consisting of 200 ppm n-octyl thiol in pentane were conducted. Separate equal volume extractions with 20 wt % sodium hydroxide in water and with polyethyleneglycol 400 (PEG) did not remove any of the n-octylthiol from the pentane solution. However, extraction with a combination of sodium hydroxide and PEG led to a greater than 90% extraction of thiol from the pentane solution and conversion to disulfide.

Example 10

As a follow-up, an alternative phase-transfer catalyst, tetrabutylammonium hydroxide (TBAOH) which combines both the PTC functionality and the high basicity in one molecule was tested. Extraction with 40 wt % aqueous TBAOH, by stirring or shaking for 5 minutes at room temperature, led to removal of thiol from the pentane to less than our detection limit (<5 ppm) with commensurate production of disulfide.

Example 11

Solid-Sequestered PTC and Aqueous Base

Figure 2:
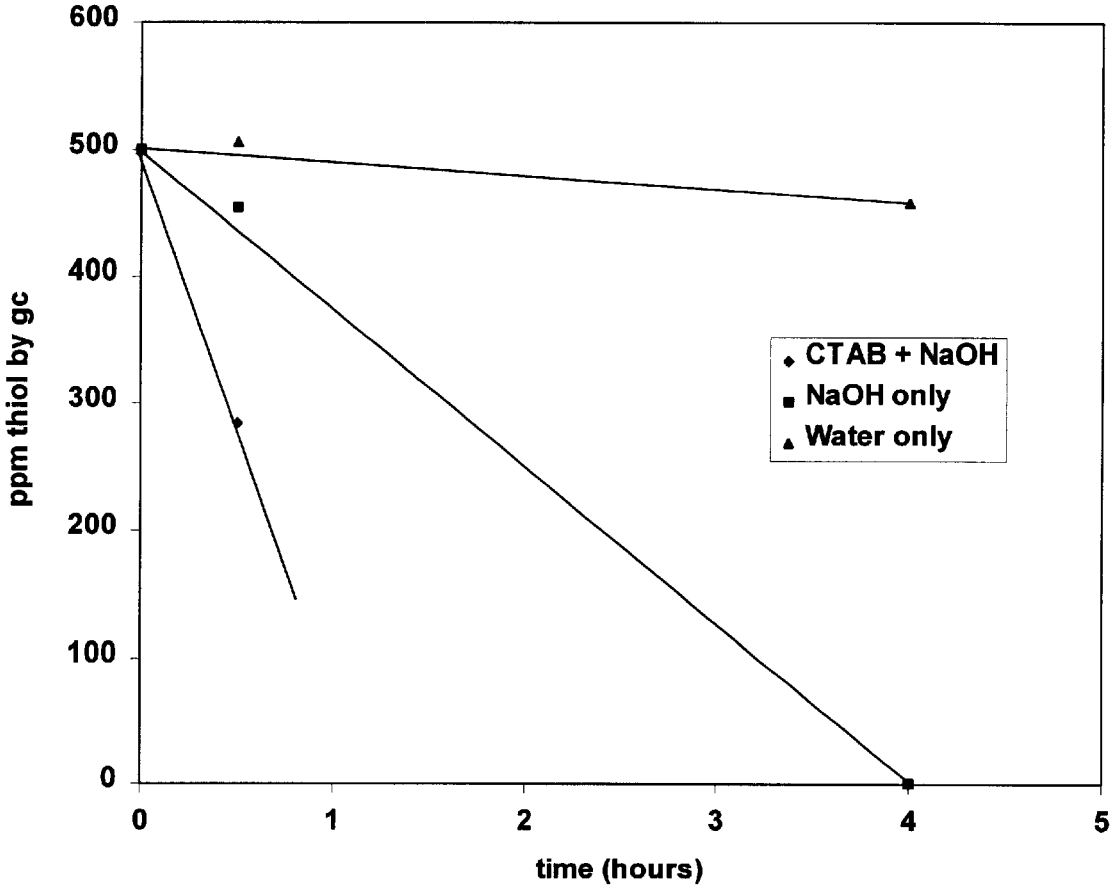
FIG. 2 depicts thiol removal by use of impregnated molecular sieves in the presence of air (sweetening).

Three types of impregnated molecular sieves were produced by separately soaking dehydrated beads (Davidson Molecular Sieves, Type 13A) in three different solutions: pure distilled water, 10 wt % NaOH in water and 5000 wppm cetyltrimethylammonium bromide (CTAB) plus 10 wt % NaOH together in water. These molecular sieves were filtered after a thirty minute soak and rinsed quickly with distilled water to remove any excess aqueous solution from the surface of the beads. The beads (4 g) were then loaded into glass vials and approximately 3 mls of 500 wppm octylthiol in pentane model feed was added. This was sufficient to fill the voids within the column of beads to maximize solution-to-bead contact. The vials were shaken every 5 minutes. Samples of the pentane solution were removed at 30 minutes and at four hours and analyzed by gc. The results are shown in FIG. 2. As expected, water soaked beads showed little impact on thiol concentration over four hours. Both the NaOH only and combined NaOH and CTAB beads produced zero thiol solutions after four hours, with the CTAB containing beads showing significantly higher initial thiol removal rates. In all cases, corresponding increases in disulfide were detected by gc.

The results are shown in FIG. 2.

What is claimed is:

1. A method for removal of mercaptans from petroleum streams comprising the steps of:

(a) extracting said petroleum stream, in the substantial absence of oxygen, with an aqueous medium comprising an aqueous base and a catalytically effective amount of a phase transfer catalyst or an aqueous solution of a catalytically effective amount of a basic phase transfer catalyst to remove said mercaptans from said petroleum stream;

(b) Separating and recovering an aqueous stream containing mercaptide anions and a petroleum stream having a reduced amount of mercaptans, and wherein when said phase transfer catalyst is a quaternary ammonium hydroxide, said quaternary ammonium cation has the formula:

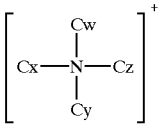

where q=1/w+1/x+1/y+1/z and wherein q≧1.0, and wherein Cw, Cx, Cy, and Cz represent alkyl radicals with carbon chain lengths of w, x, y and z carbon atoms respectively.

2. The process of claim 1 further comprising the step of processing said petroleum feedstream.

3. The process of claim 1 further comprising the steps of:

(c) subjecting said aqueous stream to oxidation to convert mercaptide anions contained therein to disulfides;

(d) separating said disulfides and recovering an aqueous stream having disulfides removed therefrom;

(e) recycling said aqueous stream to said step (a) wherein said aqueous stream contains said base and said phase transfer catalyst or said basic phase transfer catalyst of said step (a).

4. The process of claim 1 wherein said base is selected from the group consisting of sodium hydroxide, potassium hydroxide, ammonium hydroxide, sodium carbonate, potassium carbonate, and mixtures thereof.

5. The process of claim 1 wherein said PTC is supported or unsupported.

6. The process of claim 5, wherein when said PTC is a supported PTC, said support is selected from the group consisting essentially of molecular sieves, polymers, carbonaceous supports, inorganic oxides and mixtures thereof.

7. The process of claim 6 wherein said inorganic oxides are selected from the group consisting essentially of silicas, aluminas, and mixtures thereof.

8. The process of claim 5 wherein said support is regenerated by introduction of oxygen (air) air and an organic extractant into the support.

9. The process of claim 1 wherein said PTC is added in amounts of about 0.01 to about 10 wt. % of said aqueous medium.

10. The process of claim 9 wherein said base is added in amounts of up to about 50 wt % of said aqueous stream.

11. The process of claim 8 wherein said process is a swing bed process.

12. The process of claim 1 wherein prior to said step (a) said petroleum stream has been treated to remove non-mercaptan sulfur species.

13. The process of claim 1 wherein said mercaptans are $>C_5^+$ molecular weight mercaptans.

14. A method for sweetening mercaptan containing petroleum streams comprising the steps of:

(a) mixing said petroleum stream, in the presence of a sufficient amount of oxygen to oxidize the mercaptans contained in said petroleum stream to disulfides, with a medium consisting essentially of an aqueous base and a phase transfer catalyst (PTC) or an aqueous solution of a basic phase transfer catalyst to reduce the amount of said mercaptans from said petroleum stream (b) Separating and recovering an aqueous stream and a petroleum stream having mercaptans converted to disulfides therein.

15. The process of claim 1 wherein at least about 70% mercaptan removal is obtained.

16. The process of claim 1 wherein said process is run in the absence of a mercaptan oxidation catalyst.

17. The process of claim 1 wherein said aqueous medium is used in an amount of from about 5 to about 200% by volume of said petroleum stream.

* * * * *